US005888108A

United States Patent [19]

Iriono

[11] Patent Number: 5,888,108

[45] Date of Patent: Mar. 30, 1999

[54] PROPULSION SYSTEM FOR MARINE DRIVE

[75] Inventor: Yasushi Iriono, Hamamatsu, Japan

[73] Assignee: Sanshin Kogyo Kabushiki Kaisha, Japan

[21] Appl. No.: 828,599

[22] Filed: Mar. 31, 1997

[30] Foreign Application Priority Data

Mar. 29, 1996 [JP] Japan ..... 8-076733

[51] Int. Cl.[6] ..... B63H 1/15

[52] U.S. Cl. ..... 440/52; 440/80; 416/134 R

[58] Field of Search ..... 416/93 A, 134 R; 440/52, 80, 81

[56] References Cited

U.S. PATENT DOCUMENTS 3,477,794 11/1969 Abbott et al. ..... 416/134 R
4,575,310 3/1986 Otani .
4,701,151 10/1987 Uehara .
5,252,028 10/1993 LoBosco et al. ..... 440/52
5,310,371 5/1994 Iriono et al. .

*Primary Examiner*—Stephen Avila
*Attorney, Agent, or Firm*—Knobbe, Martens, Olson & Bear, LLP

[57] ABSTRACT

A propulsion system includes an improved propeller design which increases the durability of the propeller for enhanced rotational vibration damping, while simplifying the structure of the propeller. A rubber coupling is placed within a space that is secured between a propeller hub and an inner member of the propeller. The rubber coupling resiliently couples the propeller hub to the inner member with only the inner member and the propeller hub maintaining the space in which the rubber coupling is placed. The substantially constant size of the space generally isolates the rubber coupling from cyclic tension and compression stresses in the axiel and radial directions as the propeller rotates to improve the durability of the rubber coupling.

26 Claims, 9 Drawing Sheets

PROPULSION SYSTEM FOR MARINE DRIVE

BACKGROUND OF THE INVENTION

1. Field of the Invention

The present invention relates to a marine drive, and in particular to a propulsion system for a marine drive.

2. Description of the Related Art

Many watercraft employ outboard motors that are mounted on the aft end of the watercraft. An outboard motor generally includes a power head that houses an engine, a drive shaft housing situated below the power head, and a lower unit that is positioned below the drive shaft housing. The lower unit typically houses a transmission and a propulsion shaft that drives a propulsion device.

Some outboard motors employ counter-rotating propeller systems which utilize a pair of counter-rotating propellers that operate in series about a common rotational axis. By using propeller blades having a pitch of opposite hand, the dual propeller arrangement provides significant improvement in propulsion efficiency.

Prior propellers used with counter-rotating propeller systems tend to suffer from a number of drawbacks, however. Prior designs tend to be overly complicated, being formed by a multitude of components. For instance, a propeller often includes a propeller hub positioned about an inner sleeve that attaches to a propeller shaft. A rubber coupling couples the propeller hub to the inner shaft. At least one spacer is usually used to support the hub about the propeller shaft beyond a rear end of the inner sleeve. The use of all of these individual components complicates the assembly of the propeller and adds to labor and material costs.

Some conventional propeller design also use the rubber coupling to support at least a portion of the propeller hub about the inner sleeve. In this use, at least a portion of the rubber coupling undergoes cyclic tension and compression loads. The rubber eventually fatigues under these stresses and collapses into itself. The collapsed rubber coupling consequently looses a certain degree of its elasticity and no longer effectively absorbs rotational vibrations within the propeller.

SUMMARY OF THE INVENTION

A need therefore exists for a simply-structured propeller design with a reduced number of components that improves durability while enhancing vibration damping between the propeller and the propeller shaft.

One aspect of the present invention thus involves a propeller adapted to be coupled in driving relation with a propeller shaft of a marine drive. The propeller comprises a propeller hub that supports at least one propeller blade. An inner member is adapted to be affixed against rotation relative to the propeller shaft and is arranged within the propeller such that a space is defined solely by the inner member and the propeller hub. This space occurs between opposing portions of the inner member and the propeller hub. A resilient coupler cooperates with the inner member portion and with the opposing propeller hub portion to resiliently couple together the propeller hub and the inner member. The coupler is disposed within the defined space between the inner member and the propeller hub. This structure of the propeller coupling reduces the number of components to simplify assembly and reduce material and labor costs.

Another aspect of the present invention involves a propulsion system for a marine drive that includes a front propeller and a rear propeller which are arranged in series and rotate about a common axis. A pair of concentric propeller shafts drive the propellers. A first propeller shaft of the pair drives the front propeller and a second propeller shaft of the pair drives the rear propeller. At least one of the front and rear propellers comprises a propeller hub that supports at least one propeller blade. An inner member of the propeller is adapted to be affixed against rotation relative to the respective propeller shaft and is arranged within the propeller such that a space is defined solely by the inner member and the propeller hub. This space occurs between opposing portions of the inner member and propeller hub, and is generally constant. A resilient coupler cooperates with the inner member portion and with the opposing propeller hub portion to resiliently couple together the propeller hub and the inner member. The coupler is disposed within the defined space between the inner member and the propeller hub. As a result of the constant size of the space in which the resilient coupler is placed, the coupler is generally isolated for cyclic tension and compression stresses as the propeller rotates, and consequently, the durability of the coupler is enhanced.

Further aspects, features, and advantages of the present invention will become apparent from the detailed description of the preferred embodiments which follows.

BRIEF DESCRIPTION OF THE DRAWINGS

The above-mentioned and other features of the invention will now be described with reference to the drawings of preferred embodiments of the present marine propulsion system. The illustrated embodiments of the marine propulsion system are intended to illustrate, but not to limit the invention. The drawings contain the following figures.

DETAILED DESCRIPTION OF PREFERRED EMBODIMENTS OF THE INVENTION

Figure 1:
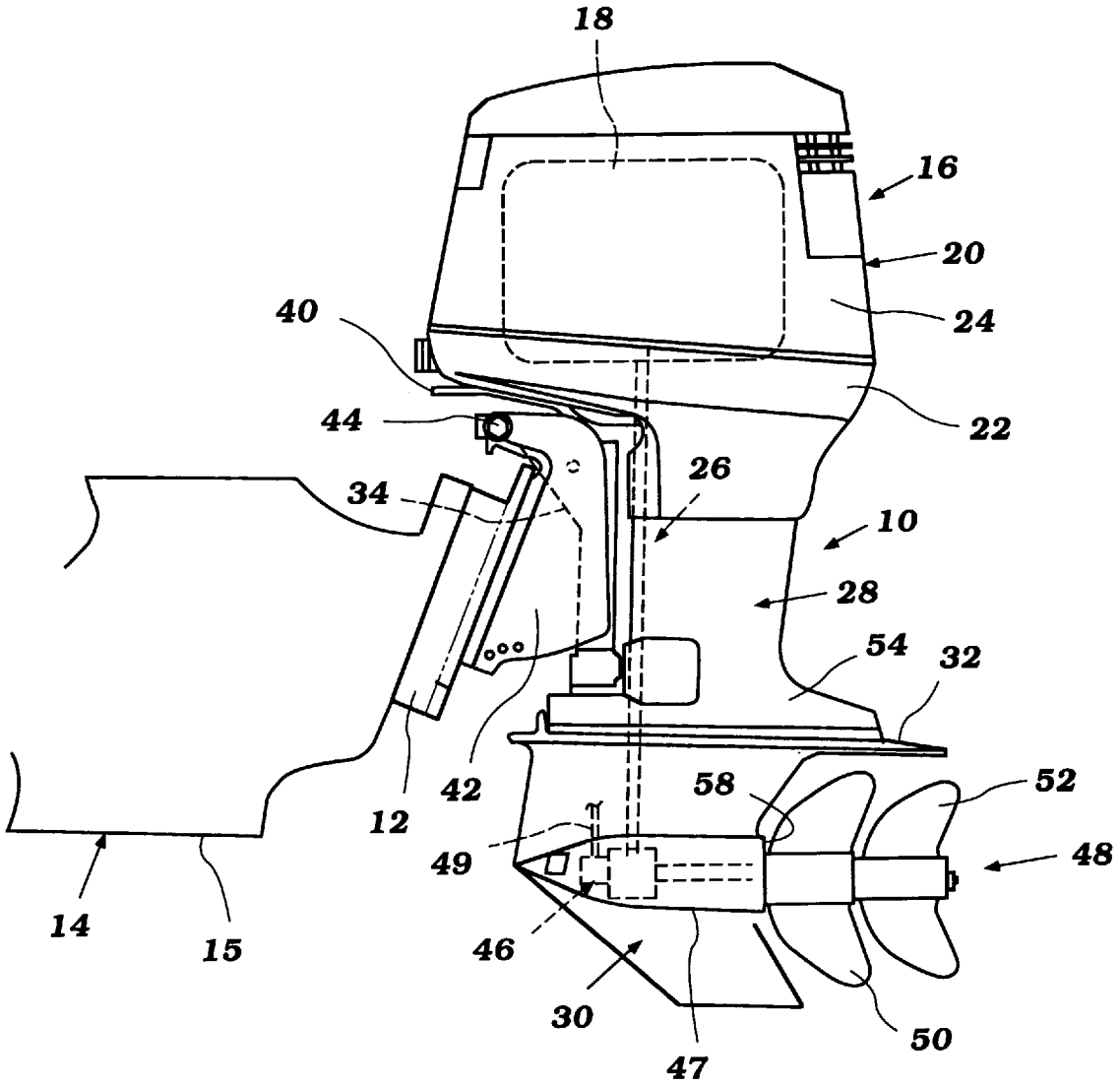
FIG. 1 is a side elevational view of an outboard motor which incorporates a propeller system that is configured in accordance with a preferred embodiment of the present invention.

FIG. 1 illustrates a marine drive 10 configured in accordance with a preferred embodiment of the present invention. In the illustrated embodiment, the marine drive 10 is depicted as an outboard motor for mounting on a transom 12 of the watercraft 14 having a bottom surface 15. It is contemplated, however, that those skilled in the art will readily appreciate that the present invention can be applied to stem drive units of inboard/outboard motors, and to other types of watercraft drive units, as well. Thus, as used herein, "marine drive" generically means an outboard motor, an inboard/outboard motor including a stem drive, and similar marine drive units. Additionally, "front" and "rear" are used herein in reference to the transom 12 of the watercraft 14.

In the illustrated embodiment, the outboard motor 10 has a power head 16 which desirably includes an internal combustion engine 18. The internal combustion engine 18 can have any number of cylinders and cylinder arrangements, and can operate on a variety of known combustion principles (e.g., on a two-stroke or a four-stroke principle).

A protective cowling assembly 20 surrounds the engine 18. The cowling assembly 20 includes a lower tray 22 and a top cowling 24. The tray 22 and the cowling 24 together define a compartment which houses the engine 18 with the lower tray 22 encircling a lower portion of the engine 18.

The engine 18 is mounted conventionally with its output shaft (i.e., a crankshaft) rotating about a generally vertical axis. The crankshaft (not shown) drives a drive shaft 26, as known in the art. The drive shaft 26 depends from the power head 16 of the outboard motor 10.

A drive shaft housing 28 extends downward from the lower tray 20 and terminates in a lower unit 30. The drive shaft 26 extends through the drive shaft housing 28 and is suitably journaled therein for rotation about the vertical axis.

A plate 32 extends outward in a substantially horizontal direction at the junction between the drive shaft housing 28 and the lower unit 30. The plate 32 acts as a splash guard as well as a cavitation plate.

A conventional steering shaft assembly 34 is affixed to the drive shaft housing 28 by upper and lower brackets (not shown). The brackets support the steering shaft assembly 34 for steering movement. Steering movement occurs about a generally vertical steering axis which extends through a steering shaft (not illustrated) of the steering shaft assembly 34. A steering arm 40, which is connected to an upper end of the steering shaft, can extend in a forward direction for manual steering of the outboard motor 10, as known in the art.

The steering shaft assembly 34 also is pivotally connected to a clamping bracket 42 by a pin 44. This convention coupling permits the outboard motor 10 to be pivoted relative to the pin 44 to permit adjustment of the trim position of the outboard motor 10 and for tilt-up of the outboard motor 10.

Although not illustrated, it is understood that a conventional hydraulic tilt-and-trim cylinder assembly, as well as a conventional steering cylinder assembly, can be used as well with the present outboard motor 10. The construction of the steering and trim mechanisms is considered to be conventional, and for that reason, further description is not believed necessary for an appreciation or understanding of the present invention.

The drive shaft 26, as schematically illustrated in FIG. 1, continues from the drive shaft housing 28 into the lower unit 30, where it drives a transmission 46, which is housed within a nacelle 47. The transmission 46 selectively establishes a driving condition of a propulsion device 48, which in the illustrated embodiment is a counter-rotating dual propeller system. A shift mechanism 49 advantageously operates the transmission 46 in forward/neutral/reverse states. In this manner, the propulsion device 48 can drive the watercraft 14 in any of these three operational states.

The level of the water relative to the watercraft 14 desirably lies proximate to the cavitation plate 32 when the watercraft is at rest (i.e., idling), is accelerating from low speeds, or is decelerating, as well as during low speed operation of the watercraft 14. The propeller system 48 is thus entirely submerged beneath water during low speed operation and acceleration/deceleration of the watercraft 14.

During high speed operation of the watercraft 14, the water level desirably lies near the bottom surface 15 of the watercraft 14. Hence, the watercraft 14 desirably planes along the water surface during high speed operation. Furthermore, only the lower portions of the propeller system 48 contact the water while the watercraft 14 is operating at high speeds. The propeller blades run partially exposed to reduce drag on the outboard motor 10, as known in the art.

Figure 2:
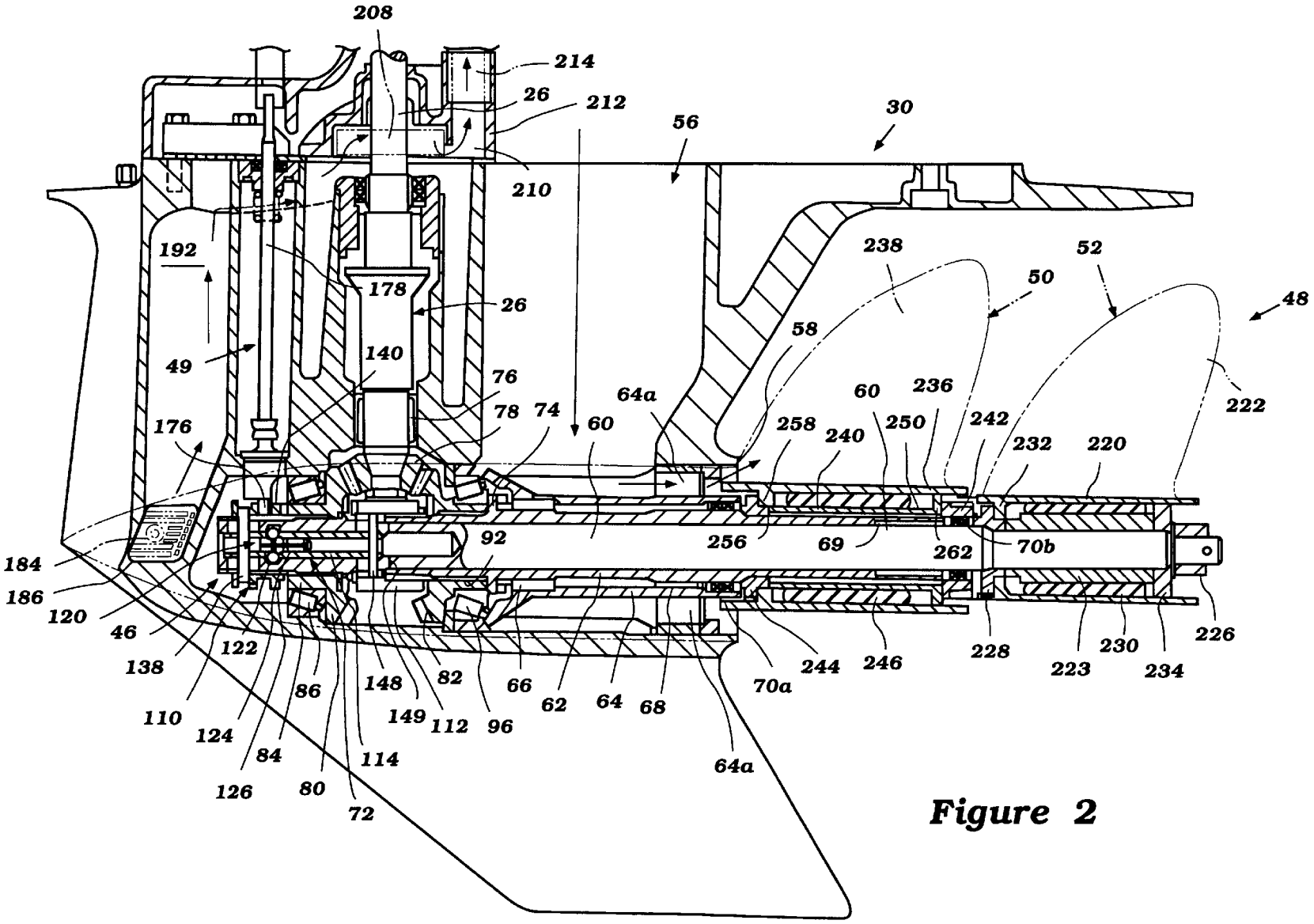
FIG. 2 is a sectional, side elevational view of a lower unit and the propeller system of the outboard motor of FIG. 1.

With reference to FIGS. 1 and 2, the counter-rotating propulsion device 48 includes a front propeller 50 designed to spin in one direction and to assert a forward thrust, and a rear propeller 52 which is designed to spin in an opposite direction and to assert a forward thrust. The propellers 50, 52 thus are of opposite hand and rotate about a common axis. The construction of the propellers will be described below.

An exhaust system discharges engine exhaust from an engine manifold (not shown) of the engine 18. The engine manifold communicates with an exhaust conduit (not shown) formed within an exhaust guide positioned at the upper end of the drive shaft housing 28. The exhaust conduit of the exhaust guide (not shown) opens into an expansion chamber 54. The expansion chamber 54 is formed within the drive shaft housing 28 and communications with a discharge conduit 56 (see FIG. 2) formed within the lower unit 30. The discharge conduit 56 terminates at a discharge end 58 formed on the rear side of the lower unit 30. In this manner, engine exhaust is discharged into the water in which the watercraft 14 is operating and in the vicinity of the propellers 50, 52 to produce a cavitation effect about the front propeller 50 to thereby improve acceleration from low speeds.

As seen in FIG. 2, an inner propeller shaft 60 drives the rear propeller 52 and a hollow outer propeller shaft drives 62 the front propeller 50. In the illustrated embodiment, the outer propulsion shaft 62 has a tubular shape. The inner propulsion shaft 60 extends through the outer propulsion shaft 62. The shafts 60, 62 desirably are coaxial and rotate about a common longitudinal axis.

The inner propeller shaft 60 and the outer propeller shaft 62 extend from the transmission system 46 through a bearing carrier 64. The bearing carrier 64 rotatably supports the outer propeller shaft 62, with the inner propeller shaft 60 journalled within the outer propeller shaft 62. A front needle bearing assembly 66 journals the front end of the outer propeller shaft 62 within the bearing carrier 64, and a rear needle bearing assembly 68 supports the outer propeller shaft 62 at the rear end of the bearing carrier 64. A second rear needle bearing assembly 69 supports and journal the inner propeller shaft 60 within and at the rear end of the hollow outer propeller shaft 62.

A first pair of oil seals 70*a* are interposed between the bearing carrier 64 and the outer propeller shaft 62 at the rear end of the bearing carrier 64. Likewise, a second pair of oil seals 70*b* are interposed between the inner propeller shaft 60 and the outer propeller shaft 62 at the rear end of the outer propeller shaft 62. The seals 70*a*, 70*b* inhibit lubricant flow beyond these points.

The rear end of the bearing carrier 64 lies within the opening on the rear side of the lower unit 30 that forms the discharge end 58. Apertures 64*a* within the structure of the bearing carrier 64 permit exhaust gases to flow over the sides of the bearing carrier 64 and through the discharge end 58, as schematically illustrated in FIG. 2.

The inner propeller shaft 60 includes a longitudinal bore 72 that stems from the front end of the inner shaft 60 in an axial direction to a point beyond an axis of the drive shaft 26. An aperture extends through the inner shaft 60, transverse to the axis of the longitudinal bore 72, at a position that is generally beneath the drive shaft 26.

The outer propulsion shaft 62 also includes an integrally formed thrust flange 74 located forward of the front needle bearing assembly 66. The thrust flange 74 has a forward facing surface that engages a thrust bearing (not shown) to transfer the forward driving thrust from the propeller 50 through the thrust bearing to the lower unit housing 30. Because the thrust flange 74 and bearing assemblies which journal the propeller shafts 60, 62 within the bearing carrier 64 form no significant part of this invention, further description of these elements is not believed necessary for an understanding of the present invention.

The engine 18 drives the propeller shafts 60, 62 through a drive train formed at least in part by the drive shaft 26 and the transmission 46. The individual components of the present transmission 46 will now be described in detail with reference to FIG. 2.

As seen in FIG. 2, the lower end of the drive shaft 26 is suitably journaled within the lower unit 30 by a bearing assemblies 76. At its lower end, the drive shaft 26 carries a drive gear or pinion 78 which forms a portion of the transmission 46. The pinion 78 preferably is a bevel-type gear.

The transmission 46 also includes a pair of counter-rotating driven gears 80, 82 that are in mesh engagement with the pinion 78. The pair of driven gears 80, 82 preferably are positioned on diametrically opposite sides of the pinion 78, and are suitably journaled within the lower unit 30, as described below. Each driven gear 80, 82 is positioned at about a 90° shaft angle with the drive shaft 26. That is, the propeller shafts 60, 62 and the drive shaft 26 desirably intersect at about a 90° shaft angle; however, it is contemplated that the drive shaft 26 and the propeller shafts 60, 62 can intersect at almost any angle.

In the illustrated embodiment, the pair of driven gears 80, 82 are a front bevel gear 80 and an opposing rear bevel gear 82. The front bevel gear includes a hub 84 which is journalled within the lower unit 30 by a front thrust bearing 86. The thrust bearing 86 rotatably supports the front gear 80 in mesh engagement with the pinion 78.

As seen in FIG. 2, the hub 84 has a center bore through which the inner propulsion shaft 60 passes. The inner propulsion shaft 60 is suitably journalled within the central bore of the front gear hub 84.

The front gear 80 also includes a series of teeth on an annular front-facing engagement surface, and includes a series of teeth on an annular rear-facing engagement surface. The teeth on each surface positively engage a portion of a clutch element of the transmission 46, as described below.

The rear gear 82 also includes a hub 92 which is suitably journaled within the bearing carrier 64 by a rear thrust bearing 96. The rear thrust bearing 96 rotatably supports the rear gear 82 in mesh engagement with the pinion 78.

The hub 92 of the rear gear 82 has a central bore through which the inner propeller shaft 60 and the outer propeller shaft 62 pass. The rear gear 82 also includes an annular front engagement surface which carries a series of teeth for positive engagement with a clutch element of the transmission 46, as described below.

As best seen in FIG. 2, the inner propulsion shaft 60 extends through the front gear hub 84 and the rear gear hub 92 and is suitable journalled therein. On the rear side of the rear gear 82, the inner propulsion shaft 60 extends through the outer propulsion shaft 62 and is suitable journalled therein.

As seen in FIG. 2, the transmission 46 also includes a front clutch 110 and a rear clutch 112 coupled to a plunger 114. As discussed in detail below, the front clutch 110 selectively couples the inner propulsion shaft 60 to the front gear 80. The rear clutch 112 selectively couples the outer propulsion shaft 62 either to the front gear 80 or to the rear gear 82. FIG. 2 illustrates the front clutch 110 and the rear clutch 112 set in a neutral position (i.e., in a position in which the clutches 110, 112 do not engage either the front gear 80 or the rear gear 82). In the illustrated embodiment, the clutches 110, 112 are positive clutches, such as, for example, dog clutch sleeves; however, it is contemplated that the present transmission 46 could be designed with friction-type clutches.

The plunger 114 includes a generally cylindrical rod-shape body and slides within the longitudinal bore 72 of the inner shaft 60 to actuate the clutches 110, 112. The plunger 114 desirably is hollow (i.e., is a cylindrical tube).

The plunger 114 includes a front hole that is positioned generally transverse to the longitudinal axis of the plunger 114 and a rear holes that is likewise positioned generally transverse to the longitudinal axis of the plunger 114. The holes desirably are each located symmetrically in relation to the corresponding apertures of the inner propulsion shaft 60, with the plunger 114 set in the neutral position.

The transmission 46 also includes a neutral detent mechanism 120 to hold the plunger 114 (and the coupled clutches 110, 112) in the neutral position. The neutral detent mechanism 120 operates between the plunger 114 and the inner propulsion shaft 60, and is located toward the front end of the inner propulsion shaft 60.

As best seen in FIG. 2, the neutral detent mechanism 120 is formed in part by at least one and preferably two transversely positioned holes in the plunger 114. These holes receive detent balls 122. The detent balls 122 each have a diameter which is slightly smaller than the diameter of each hole.

The inner propulsion shaft 60 includes an annular groove 124 which is formed on the inner wall of the bore 72 through which the plunger 114 slides. The groove 124 is positioned within the bore 72 so as to properly locate the clutches 110, 112 in the neutral position when the detent holes of the plunger 114 coincide with the axial position of the annular groove 124. A spring plunger 126, formed in part by a helical compression spring, biases the detent balls 122 radially outwardly against the inner wall of the inner propulsion shaft bore 104. The plunger 114 contains the spring plunger 126 within its tubular body.

The spring plunger 126 forces portions of the detent balls 122 into the annular groove 124 when the plunger 114 is moved into the neutral position. This releasable engagement between the detent balls 122 carried by the plunger 114 and the annular groove 124 of the inner propulsion shaft 60 releasably restrains movement of the plunger 114 relative to the inner propulsion shaft 60, as known in the art. Because the detent mechanism 120 is believed to be conventional, further description of the detent mechanism 120 is thought unnecessary for an understanding of the present transmission 46.

As seen in FIG. 2, the front dog clutch 110 has a generally cylindrical shape that includes an axial bore. The bore extends through an annular front end and a flat annular rear end of the clutch 110. The bore is sized to receive the inner propulsion shaft 60. Internal splines are formed on the wall of the axial bore. The internal splines mate with external spines formed on the front end of the inner propulsion shaft 60. The resulting spline connection establishes a driving connection between the front clutch 110 to the inner propulsion shaft 60, while permits the clutch 110 to slide along the front end of shaft 110.

The annular rear end surface of the clutch 110 lies generally transverse to the longitudinal axis of the inner propulsion shaft 60. The rear surface of the front dog clutch 110 also is substantially coextensive in the area with the annular front surface of the front gear 80. Teeth extend from the clutch rear surface in the longitudinal direction and desirably corresponds with the teeth on the front surface of the front driven gear 80, both in size (i.e., axial length), in number, and in configuration.

A pair of annular grooves circumscribe the exterior of the front clutch 110. A front groove is sized to receive a retaining spring, as described below. The rear groove is sized to cooperate with an actuator mechanism, which will be described below.

The front clutch 110 also includes a traverse hole that extends through the clutch 110 at the location of the front annular groove. The hole is sized to receive a pin 138 which, when passed through the front aperture 140 of the inner propulsion shaft 60 and through the front hole of the plunger 114, interconnects the plunger 114 and the front clutch 110 with the front clutch 110 positioned on the inner propulsion shaft 60. The pin 138 may be held in place by a press-fit connection between the pin 138 and the front hole, or by a conventional coil spring (not shown) which is contained within the front annular groove about the exterior of the front clutch 110.

The rear clutch 112 is disposed between the two counter-rotating driven gears 80, 82. The rear clutch 112 has a tubular shape that includes an axial bore which extends between an annular front end and an annular rear end. The bore 140 is sized to receive a portion of the outer propulsion shaft 62, which is positioned about the inner propulsion shaft 60.

The annular end surfaces of the rear clutch 112 are substantially coextensive in size with the annular engagement surfaces of the front and rear gears 80, 82, respectively. Teeth extend from the front end of the rear clutch 112 and desirably correspond to the respective teeth of the front gear 80 in size (e.g., axial length), in number, and in configuration. Teeth likewise extend from the rear end surface of the rear clutch 112 and desirably correspond to the respective teeth of the rear gear 82 in size (e.g., axial length), in number, and in configuration.

A spline connection couples the rear clutch 112 to the outer propulsion shaft 62. The clutch 112 thus drives the outer propulsion shaft 62 through the spline connection, yet the clutch 112 can slide along the front end of the shaft 62 between the front and rear gears 80, 82.

As seen in FIG. 2, the rear clutch 112 also includes a counterbore. The counterbore is sized to receive a coupling pin 148 which extends through the rear aperture 149 of the inner propulsion shaft 60 and through the rear hole of the plunger 114. The ends of the pin 148 desirably are captured by an annular bushing which is interposed between a pair of roller bearings. The assembly of the couplings and bearings is captured between a pair of washers and locked within the counterbore of the rear clutch 112 by a retainer ring (not shown). The roller bearings journal the assembly of the bushing and the pin 148 within the counterbore to allow the bushing and the pin 148 to rotate in an opposite direction from the rear clutch 112. The pin 148, being captured within the counterbore of the rear clutch 112, however, couples the plunger 114 to the rear clutch 112 in order for the plunger 114 to actuate the rear clutch 112.

As seen in FIG. 2, the actuator mechanism 49 moves the plunger 114 of the clutch assembly from a position establishing a forward drive condition, in which the front and rear clutches 110, 112 engage the front and rear gears 80, 82, respectively, through a position of non-engagement (i.e., the neutral position), and to a position establishing a reverse drive condition, in which the rear clutch 112 engages the front gear 110. The actuator mechanism 49 positively reciprocates the plunger 114 between these positions.

The actuator mechanism 49 includes a cam member 176 that connects the front clutch 110 to a rotatable shift rod 178, which is housed within a sealed vertical chamber within the lower unit 30. In the illustrated embodiment, the shift rod 178 is journalled for rotation in the lower unit 30 and extends upwardly to the transmission actuator mechanism 49 positioned within the outboard motor cowling 20. The actuator mechanism 49 (not shown) converts rotational movement of the shift rod 178 into linear movement of the front clutch 110 to move the front clutch 110, as well as the plunger 114 and the rear clutch 112, along the axis of the propulsion shaft 60, 62.

The cam member 176 is affixed to a lower end of the shift rod 178. The cam member 176 includes an eccentrically positioned drive pin 138 which extends downward from the cam member 176 and cooperates with the rear groove on the front clutch element 110. The cam member also includes a cylindrical upper portion which is positioned to rotate about the axis of the shift rod 178 and is journaled within the lower unit 30.

The drive pin 138 of the cam member 176 moves both axially and transversely with rotation of the cam member 176 because of the eccentric position of the drive pin 138 relative to the rotational axis of the cam member 176. The axial travel of the drive pin 138 causes the coupled clutch 110 to move axially, sliding over the inner propulsion shaft 60, as discussed in detail below.

As noted above, the pin 138 connects the front clutch 110 to the plunger 114. This coupling causes the plunger 114 to rotate with the front clutch 110 and the inner propulsion shaft 60. The coupling also conveys the axial movement of the clutch 110 driven by the actuator mechanism 49 to the plunger 114. The plunger 114 consequently moves the rear clutch 112 which travels with the plunger 114.

FIGS. 1 and 2 also illustrates a water pick-up system for the outboard motor 10. A water inlet 184 is located on each side of the front end of the lower unit 30. Each water inlet 184 is defined by an opening that extends through the lower unit 30 and is located on an upper side of the front portion of the nacelle, forward of the transmission 46. A cover 186 is positioned over each water inlet 184.

Each opening 184 extends through the nacelle 47 and communicates with a water passage 192 that extends upward through the lower unit 30. The water passage 192 desirably is positioned forward of the transmission 46 and the shift rod 178 and is separated therefrom by an internal wall within the lower unit 30.

The water passage 192 communicates with a water pump 208. The water pump 208 is located within the drive shaft housing 28 immediately above the junction where the drive shaft housing 28 meets the lower unit 30. The water pump 208 is coupled to the drive shaft 26 such that the drive shaft 26 powers the pump 208.

The water pump 208 communicates with a water tube fitting 210 that is located on a rear side of the water pump 208. The water tube fitting 210 is defined by a wall 212 that separates the water tube fitting 210 from the discharge conduit 56. A flexible tube 214 is connected to the water tube fitting 210 and extends upward through the drive shaft housing 28 to communicate with water jackets (not shown) that extend through the engine 18.

As the watercraft travels through water, the relative velocity between the water and the nacelle 47 urges water through the plurality of openings 184 in the water inlet cover 186. The momentum of the water as it passes through the inlet propels the water upward through the water passage 192, thus filling the water passage 192 with water. The pump 208 also helps draw water into the water passage 192, especially at low speeds. The water pump 208 then pumps the water from the water passage 192 and into the water tube fitting 210 and delivery tube 214. The water delivery tube 214 guides the water to the engine 18 for cooling. The method by which the water, once within the engine, cools the engine is considered to be conventional. For that reason, further description is not believed to be necessary for an appreciation or understanding of the present invention.

Figure 3:
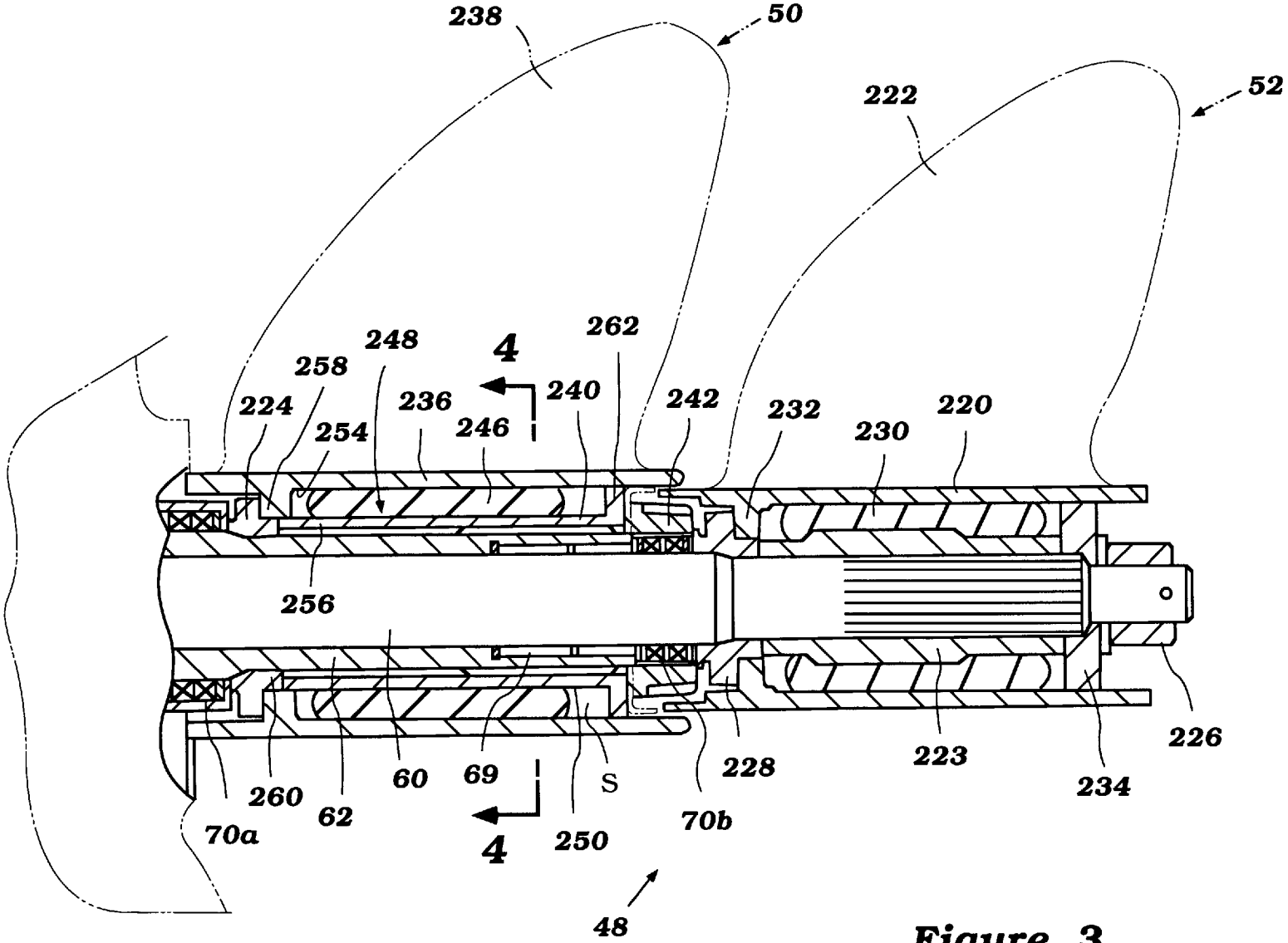
FIG. 3 is an enlarged, sectional side view of the propeller system of FIG. 2.

FIG. 3 best illustrates the components of the front and rear propellers 50, 52. The rear propeller includes a hub 220 to which propeller blades 222 are integrally attached. An inner propulsion shaft 60 drives the rear propeller hub 220. For this purpose, the rear end of the inner propulsion shaft 60 carries an engagement sleeve 223 of the propeller 52 which has a spline connection with the rear end of the rear propulsion shaft 60. The sleeve 223 is fixed to the rear end of the inner shaft 60 between a nut 226 threaded on the rear end of the shaft 64 and a rear thrust washer 228 positioned between the front and rear propeller 50, 52.

An elastic coupling 230 is interposed between the inner engagement sleeve 223 and the rear propeller hub 220. The coupling 230 is secured to the engagement sleeve 223 by a known heat process, such as, for example, shrink fit process or the like, or by an adhesive bonding. The coupling 230 is attached to the inner surface of the propeller hub 220 also by suitable means, such as, for example, by a known heat process or an adhesive bonding.

The engagement between the hub 220 and the elastic coupling 230 is sufficient to transmit rotational forces from the engagement sleeve 223, driven by the inner propulsion shaft 60 to the rear propeller blades 222. The coupling 230 also provides vibration damping between the drive shaft 60 and the propeller hub 220.

The hub 220 is supported about the inner sleeve 223 by an annular inner flange 232 and a spacer 234. The inner flange 232 of the hub 220 engages a portion of the thrust washer 228. The spacer 234 fits behind the inner sleeve 223, between the inner shaft 60 and the propeller hub 220 with the nut 226 securing the spacer 234 in this location.

The front propeller 50 includes a propeller hub 236. Propeller blades 238 are integrally formed on the exterior of the hub 236.

Figure 4:
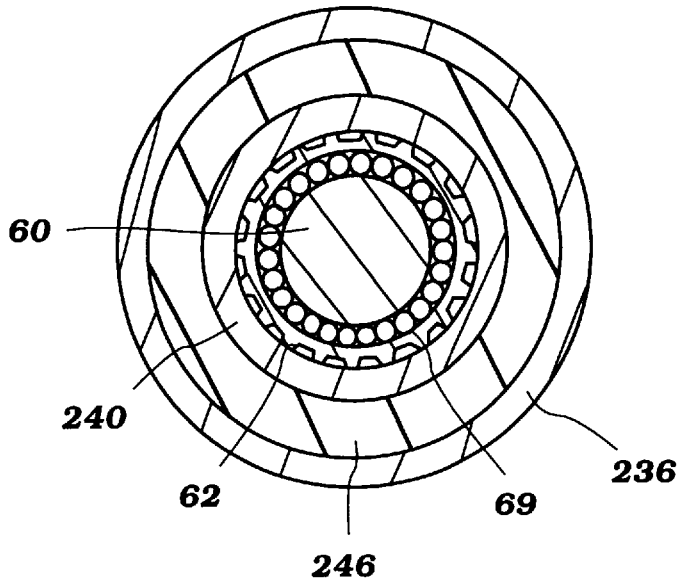
FIG. 4 is a cross-sectional view of the propeller system of FIG. 3 taken along line 4—4.

An outer propulsion shaft 62 carries the front propeller 50. As best seen in FIGS. 3, and 4 the rear end portion of the outer propulsion shaft 62 carries a front engagement sleeve 240 of the front propeller 50 and drives the engagement sleeve 240 by a spline connection. The front engagement sleeve 240 is secured onto the outer propulsion shaft 62 between an annular retaining ring 242 and a front thrust valve 224.

A front annular elastic coupling 246 surrounds the front engagement sleeve 240. The coupling 246 is secured to the sleeve 240 by a variety of suitable ways known in the art, such as, for example, by a heat shrink process or by an adhesive bonding.

The front propeller hub 236 surrounds the elastic coupling 246, which is secured to an inner surface of the propeller hub 236 by a suitable manner, such as, for example, by a heat shrink process or by an adhesive bonding. The engagement between the propeller hub 236 and the coupling 246 is sufficient to transmit a rotational force from the sleeve 240 to the propeller blades 238 of the front propeller hub 236. The elastic coupling 246 dampens vibration between the outer propulsion shaft 62 and the front propeller hub 236.

The elastic coupling 246 desirably is contained within a substantially constant space S that is defined solely between an inner member 248 and the propeller hub 236. The constant space S inhibits deformation of the elastic coupling 246 which minimizes the degree of cyclic tension and compression stresses placed on the elastic coupling as the propeller 50 rotates. As a result, the elastic material of the coupling 246 is less likely to fatigue and the durability of the coupling 246 is improved.

In the illustrated embodiment, the space S is defined between an annular surface 250 of the inner sleeve 240, which forms part of the inner member 248, and an inner periphery surface 254 of the propeller hub 236. Cooperating structure between the propeller hub 236 and the inner member 248 maintain the spacing between the opposing surface 252, 254 of these components 236, 240. In the illustrated embodiment, the propeller hub 236 includes a radial extending member which extends inward from the inner periphery 254 of the propeller hub 236 and contacts at least a front end 256 of the inner sleeve 240. In particular, the radial extending member comprises an annular flange 258 that extends about the inner periphery 254 of the propeller hub 236. The annular flange 258 contacts the front end 256 of the inner sleeve 240 as well as hub portion 260 of the front thrust flange 224. This structure substantially prevents relative movement between the inner member 248 and the hub 236 in a direction transverse (i.e., radial) to a rotational axis of the propeller 50 as the propeller rotates.

The inner member 248 also includes a radial extending member that supports the propeller hub 236 about a rear end of the engagement sleeve 240. In the illustrated embodiment, the radial extending member is an annular flange 262 that circumscribes a rear end of the engagement sleeve 240. An outer end of the annular flange 262 fits within the inner periphery 254 of the propeller hub 236 in generally a slip-fit manner. As such, the annular flange 262 contacts the inner periphery 254 of the propeller hub 236. This structure, like the front structure, substantially prevents relative movement between the propeller hub 236 and the inner member 248 in the transverse (i.e., radial) direction as the propeller 50 rotates.

The radial extending member and the inner sleeve desirably are integrally formed. That is, the inner member 248 is a unitary piece. As described in connection with other embodiments, however, the inner member 248 can be formed by separate components that are attached together (e.g., by an adhesive bonding or welding) before assembly.

Importantly the space S in which the elastic coupling 246 is placed is formed solely by the inner member 248 and the propeller hub 236. As a result, the number of components that form the propeller 50 is reduced in comparison to prior propeller designs to decrease assembly labor and material costs associated with the propeller 50.

The following elaborates upon the foregoing description of the operation of the transmission 46 and the propeller system 48. FIG. 2 illustrates the front and rear clutches 110, 112 in the neutral position, i.e., a position of non-engagement with the gears 80, 82. The detent mechanism 120 maintains the plunger 114 and the coupled clutches 110, 112 in this position.

To establish a forward drive condition, the shift rod 178 rotates the cam member 176 in a manner which moves the drive pin of the cam member 176 axially in the reverse direction. In the illustrated embodiment, clockwise rotation of the shift rod 178 moves the drive pin axially in the rearward direction. The clutch 110 thus follows the drive pin to slide the front clutch 110 over the inner propulsion shaft 64. The actuator mechanism 49 thereby forces the front clutch 110 into engagement with the front gear 80, with the corresponding clutch teeth mating. So engaged, the front gear 80 drives the inner propulsion shaft 60 through the internal spline connection between the clutch 110 and the inner propulsion shaft 60. The inner propulsion shaft 60 thus drives the rear propeller 52 in a first direction which asserts a forward thrust.

The forward motion of the clutch 110 also causes the plunger 114 to slide within the longitudinal bore 72 of the inner propulsion shaft in the reverse direction due to the direct coupling of the drive pin 138. The plunger 114 moves the rear coupling pin 148 in the rearward direction to force the rear clutch 112 into engagement with the rear gear 82 with the corresponding teeth mating.

Once the teeth of the rear clutch 112 register with the teeth of the rear gear 82, the rear clutch 112 engages with the rear gear 82. So engaged, the rear gear 82 drives the outer propulsion shaft 62 through the spline connection between the rear clutch 112 and the outer propulsion shaft 62. The outer propulsion shaft 62 thus drives the front propeller 50 to spin in an opposite direction to that of the rear propeller 52 and to assert a forward thrust.

To establish a reverse drive condition, the shift rod 178 rotates in an opposite direction so as to move the cam member 176 and the eccentrically positioned drive pin in a direction which moves the drive pin axially in the forward direction. Again, in the illustrated embodiment, clockwise rotation of the shift rod 178 rotates the drive pin 138 so as to move the drive pin axially in the forward direction. The forward movement of the drive pin 138 is transferred to the front clutch 110. This motion also is transferred to the plunger 114 through the clutch 110 and the corresponding coupling pin 138. The forward motion of the plunger 114 positively forces the rear clutch 112 into engagement with the front gear 80 with the corresponding clutching teeth mating.

Once the corresponding teeth of the rear clutch 112 and front gear 80 register, the front gear 80 and rear clutch 112 engage. So engaged, the front gear 80 drives the outer propulsion shaft 62 through the spline connection between the rear clutch 112 and the outer propulsion shaft 62. The outer propulsion shaft 62 thus drives the front propeller 50 in a direction which asserts a reverse thrust to propel the watercraft 14 in reverse.

In the illustrated embodiment, only the front propeller 50 includes the improved construction; however, it is understood that either propeller 50, 52 or both propellers 50, 52 can include the improved propeller construction. In addition, it is understood that the front propeller 50, with the improved construction, can be used with a transmission that drives the front propeller 50 only during forward drive conditions and drives the rear propeller 52 under both forward and reverse drive conditions. Such a transmission is illustrated in U.S. Pat. No. 5,449,306, issued Sep. 12, 1995, to Nakayasu et al., entitled "Shifting Mechanism For Outboard Drive", and assigned to the assignee of this application, which is hereby incorporated by reference.

Several additional embodiments of the propeller system designed to carry out the improvements described above are disclosed below. Each of these embodiments employs the same basic concepts characteristic of improving the durability of the resilient coupling between the propeller hub and the propeller shaft, as well as reducing the number of components of the propeller. For ease of description, similar features are ascribed the same reference numeral used for corresponding elements of the embodiments.

Figure 5:
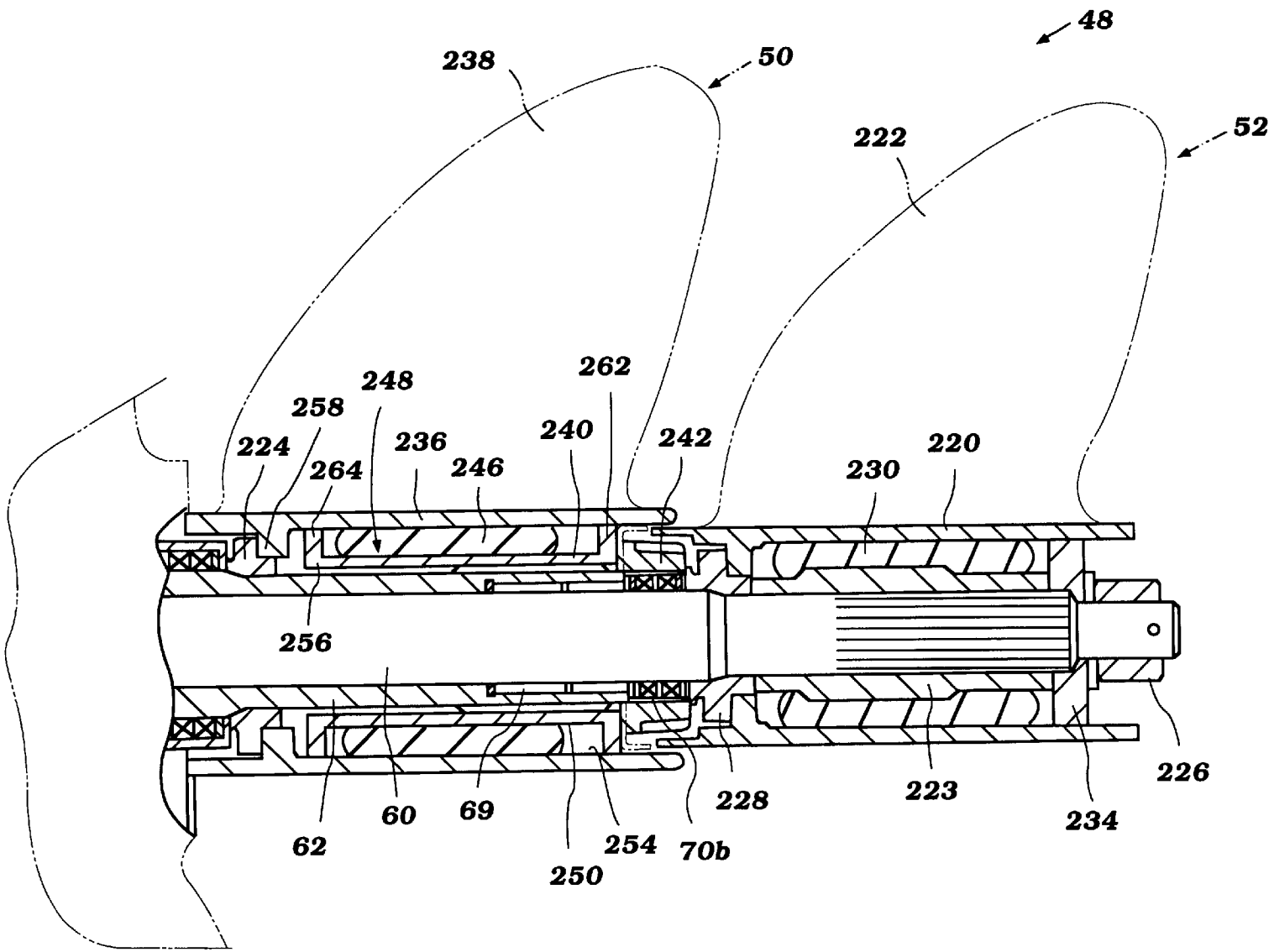
FIG. 5 is a sectional side view of a propeller system configured in accordance with another preferred embodiment of the present invention.

With reference to FIG. 5, the front propeller 50 includes a similar design to that described above, except for the structure supporting the propeller hub 236 about the outer propeller shaft 62. In the illustrated embodiment, the inner member 248 includes radial extending members at the ends of the space S. Each radial extending member desirably is an annular flange 262, 264 that circumscribes the inner engagement sleeve 240. The annular flanges 262, 264 are sized to support the propeller hub 236 at a defined distance from the inner sleeve 240 so as to define the generally constant space S between the annular flanges 262, 264 and the between the inner periphery surface 254 and the surface 250 of inner sleeve 240. The outer ends of the flanges 262, 264 contact the inner periphery of the propeller hub 236, desirably in a slip-fit manner.

The space S thus is formed solely by the inner member 248 and the inner periphery surface 254 of the propeller hub 236. No other components define the generally constant space S. In addition, this structure substantially inhibits relative radial movement between the inner sleeve 240 and the propeller hub 236.

The front flange 258 on the propeller hub 236 abuts against the front thrust flange 224. In this manner, axial thrust from the propeller hub 236 is transferred to the outer propeller shaft 62 through the thrust flange 224. Substantially no thrust force is transferred through the elastic coupling 246 because of the slip-fit contact between the inner member 248 and propeller hub periphery 254 and the spline connection between the inner member 248 and the propeller shaft 62.

The construction of the rear propeller 52, the propeller shafts 60, 62 the transmission 46, and the lower unit 30 desirable are identical to the above description.

Figure 6:
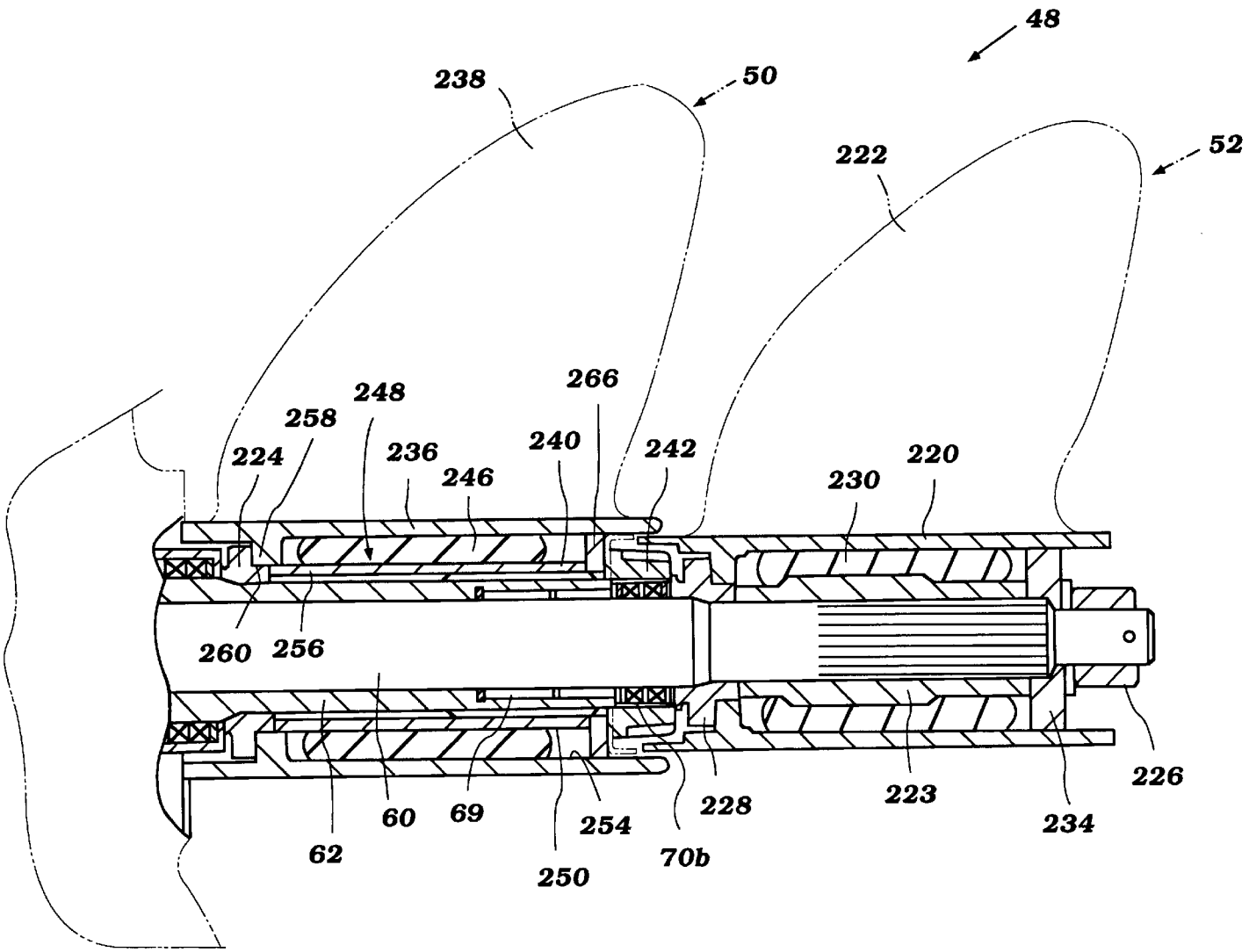
FIG. 6 is a sectional side view of a propeller system configured in accordance with an additional preferred embodiment of the present invention.
Figure 7:
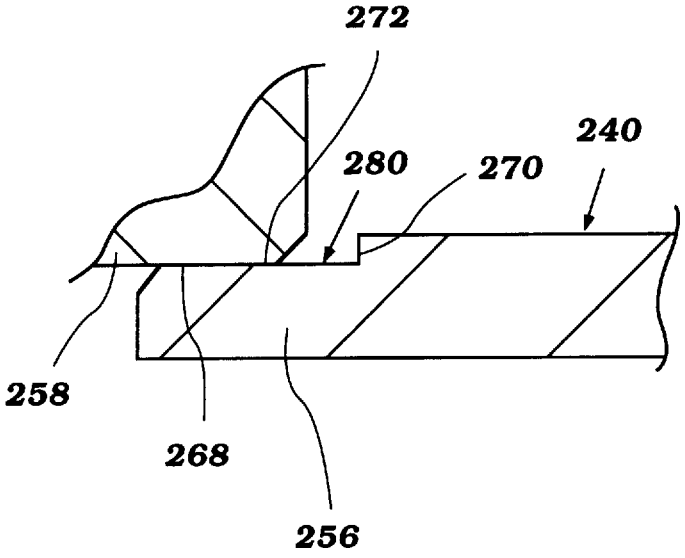
FIG. 7 is an enlarged sectional view of a portion of a propeller of the propeller system of FIG. 6.

FIGS. 6 and 7 illustrate another embodiment of a propeller design in connection with the front propeller 50. This embodiment is substantially identical to the front propeller design illustrated FIG. 3, except for the construction of the inner member 248 and relationship between the front annular flange 258 of the propeller hub 236 and the contact surface 250 of the inner sleeve 240. Lie the embodiment of FIG. 5, the construction of the rear propeller 52, the propeller shafts 60, 62 the transmission 46, and the lower unit 30 desirable are identical to like components of the embodiment described in FIG. 3.

The inner member 248 comprises an inner engagement sleeve 240 and a radial extending member. The inner sleeve 240 has a tubular shape and includes internal splines that cooperate with external splines formed on the exterior of the outer propeller shaft 62.

The radial extending member desirably is an annular ring 266 that is attached to the inner sleeve 240 by suitable means, such as, for example, by welding or by an adhesive bonding. The ring 266 is concentrically positioned relative to the inner sleeve 240. The outer diameter of the ring 266 is sized to be slightly smaller than the diameter of the inner periphery surface 254 of the propeller hub 236 to fit within the propeller hub 236 in a slip-fit manner.

As best seen in FIG. 7, the front annular flange 258 of the propeller hub 236 contacts a bearing surface 268 on the outer periphery 250 (FIG. 6) of the engagement sleeve front end 256. A step 270 is located behind the bearing surface 268 to function as a stop. An inner end 272 of the annular flange 258 contacts and sits flush against the bearing surface 268 to firmly support the propeller hub 236 about the inner sleeve 240. The annular flange 258 also lies in front of the step 270 with a small space (280) occurring between the step 270 and the annular flange 258. This arrangement allows for a limited degree of relative movement between the propeller hub 236 (FIG. 6) and the inner member 248 in the axial direction toward the rear propeller 52. (FIG. 6)

Figure 8:
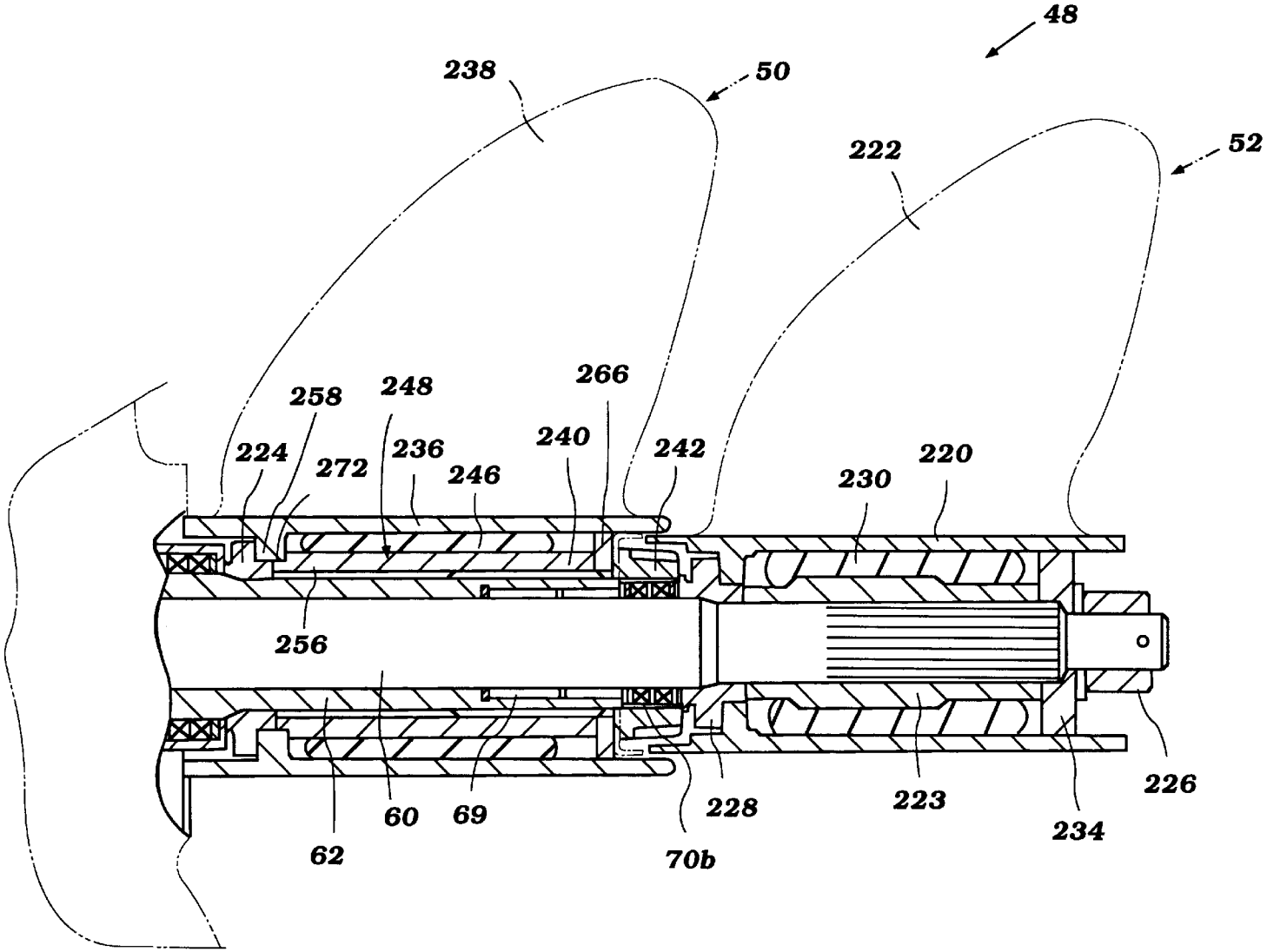
FIG. 8 is a sectional side view of a propeller system configured in accordance with an additional preferred embodiment of the present invention.
Figure 9:
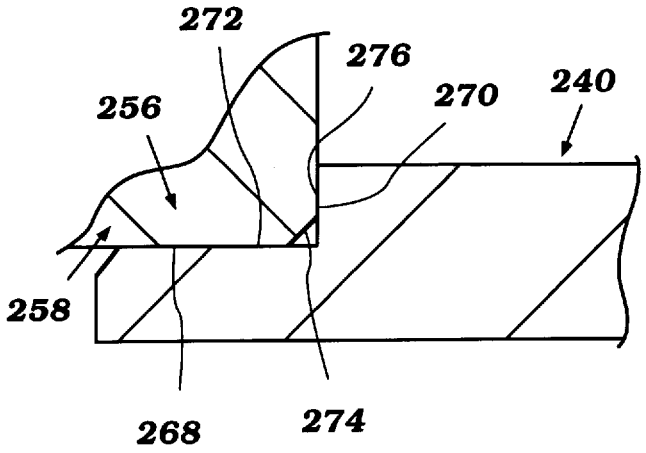
FIG. 9 is an enlarged sectional view of a portion of a propeller of the propeller system of FIG. 8.

FIGS. 8 and 9 disclose a very similar propeller design to that illustrated in FIGS. 6 and 7, with the exception of the contact arrangement between the front annular flange 258 of the propeller hub 236 and the inner sleeve 240. In this embodiment, the front annular flange 258 contacts a bearing surface 268 on the outer periphery of the engagement sleeve front end 256. A step 270 is located behind the bearing surface 268. An inner end 272 of the annular flange 258 contacts and sits flush against the bearing surface 268 to firmly support the propeller hub 236 about the inner sleeve 240. The annular flange 258 also abuts against the front side of the step 270 to establish a firm and secure contact between the inner sleeve 240 and the inner end 272 of the annular flange 258. As seen in FIG. 9, the flange 258 may also include a small chamfer 274 to ensure good contact between the step 272 and a rear side 276 of the annular flange 258. In this position, the annular flange 258 is locked between the inner sleeve 240 and the front thrust flange 224 to inhibit relative axial movement between these components.

As common to each of the above-described embodiment, at least one of the propellers includes few number of components. In addition, the resilient coupling in the propeller is generally isolated from radial movement of the propeller hub relative to the rotational axis by positioning the coupling within a space having a generally constant size. Each of the above embodiments also include unique advantages associated with the particular propeller design. For this reason, it is understood that those skilled in the art will be readily able to adapt certain features of one embodiments to another in order to suit a particular application.

Although this invention has been described in terms of certain preferred embodiments, other embodiments apparent to those of ordinary skill in the art are also within the scope of this invention. Accordingly, the scope of the invention is intended to be defined only by the claims that follow.

What is claimed is:

1. A propeller adapted to be coupled in driving relation with a propeller shaft of a marine drive, the propeller comprising a propeller hub supporting at least one propeller blade, an inner member adapted to be affixed against rotation relative to the propeller shaft, a space being defined solely by the inner member and the propeller hub with the space occurring between opposing portions of the inner member and propeller hub, a resilient coupler cooperating with the inner member portion and with the opposing propeller hub portion to resiliently couple together the propeller hub and the inner member, the coupler being disposed within the defined space between the inner member and the propeller hub the propeller hub being arranged so as to bear on the propeller shaft in at least one axial direction independent of the coupler.

2. A propeller as in claim 1, wherein the inner member and the propeller hub include cooperating structure that maintains a constant spacing between the opposing portions of the inner member and the propeller hub.

3. A propeller as in claim 1, wherein the inner member includes an inner sleeve and at least one radial extending member that projects from the sleeve and supports an inner periphery of the propeller hub about at least a portion of the sleeve.

4. A propeller as in claim 3, wherein the radial extending member is an annular flange that circumscribes the inner sleeve.

5. A propeller as in claim 4, wherein the inner member includes another annular flange that circumscribes the inner sleeve, the inner flanges being disposed generally at opposite ends of the inner sleeve.

6. A propeller as in claim 3, wherein the propeller hub includes at least one radial extending member that projects inward toward the inner sleeve and contacts a portion of the inner sleeve, and the space is defined between the radial extending members of the inner sleeve and the propeller hub.

7. A propeller as in claim 6, wherein each radial extending member is an annular flange with the annular flange of the inner member circumscribing the inner sleeve and the annular flange of the propeller hub extending about an inner periphery of the propeller hub.

8. A propeller as in claim 7, wherein the inner sleeve and the annular flange are integrally formed.

9. A propeller as in claim 1, wherein the propeller hub includes at least one radial extending member that projects inward towards the inner member and is arranged so as to bear on the propeller shaft in at least one axial direction.

10. A propeller as in claim 6, wherein the inner sleeve includes a relief which receives the radial extending member of the propeller hub in a manner inhibiting axial movement of the propeller hub relative to the inner member in at least one direction.

11. A propeller as in claim 6, wherein the inner sleeve includes a bearing surface and a stop arranged at one end of the bearing surface, and the radial extending member of the propeller hub contacts the bearing surface in a manner permitting a degree of axial movement of the propeller hub relative to the inner member.

12. A propeller adapted to be coupled in driving relation with a propeller shaft of a marine drive, the propeller comprising a propeller hub supporting at least one propeller blade, an inner member adapted to be affixed against rotation relative to the propeller shaft, a space being defined solely by the inner member and the propeller hub with the space occurring between opposing portions of the inner member and propeller hub, a resilient coupler cooperating with the inner member and with the opposing propeller hub to resiliently couple together the propeller hub and the inner member, the coupler being disposed within the defined space between the inner member and the propeller hub, the inner member including an inner sleeve and at least one radial extending member that projects from the sleeve and supports an inner periphery of the propeller hub about at least a portion of the sleeve, the propeller hub including at least one radial extending member that projects inward toward the inner sleeve and contacts a portion of the inner sleeve, the space being defined between the radial extending members of the inner sleeve and the propeller hub, the inner sleeve including a relief that receives the radial extending member of the propeller hub in a manner inhibiting axial movement of the propeller hub relative to the inner member in at least one direction.

13. A propeller adapted to be coupled in driving relation with a propeller shaft of a marine drive, the propeller comprising a propeller hub supporting at least one propeller blade, an inner member adapted to be affixed against rotation relative to the propeller shaft, a space being defined solely by the inner member and the propeller hub with the space occurring between opposing portions of the inner member and propeller hub, a resilient coupler cooperating with the inner member and with the opposing propeller hub to resiliently couple together the propeller hub and the inner member, the coupler being disposed within the defined space between the inner member and the propeller hub, the inner member including an inner sleeve and at least one radial extending member that projects from the sleeve and supports an inner periphery of the propeller hub about at least a portion of the sleeve, the propeller hub including at least one radial extending member that projects inward toward the inner sleeve and contacts a portion of the inner sleeve, the space being defined between the radial extending members of the inner sleeve and the propeller hub, the inner sleeve including a bearing surface and a stop arranged at one end of the bearing surface, and the radial extending member of the propeller hub contacting the bearing surface in a manner permitting a degree of axial movement of the propeller hub relative to the inner member.

14. A propulsion system for a marine drive comprising a front propeller and a rear propeller arranged in series to rotate about a common axis, a pair of concentric propeller shafts, the front propeller being attached to a first propeller shaft of the pair to drive the front propeller, the rear propeller being attached to a second propeller shaft of the pair to drive the rear propeller, at least one of the front and rear propellers comprising a propeller hub supporting at least one propeller blade, an inner member adapted to be affixed against rotation relative to the respective propeller shaft, a space being defined solely by the inner member and the propeller hub with the space occurring between opposing portions of the inner member and propeller hub, the space having a generally constant size, a resilient coupler cooperating with the inner member portion and with the opposing propeller hub portion to resiliently couple together the propeller hub and the inner member, the coupler being disposed within the defined space between the inner member and the propeller hub, the propeller hub being arranged so as to bear on the propeller shaft in at least one axial direction independedent of the coupler.

15. A propulsion system as in claim 14, wherein the inner member includes an inner sleeve and at least one annular flange that circumscribes the inner sleeve.

16. A propulsion system as in claim 15, wherein the inner member includes another annular flange that circumscribes the inner sleeve, the inner flanges being disposed generally at opposite ends of the inner sleeve.

17. A propulsion system as in claim 16 additionally comprising a transmission which drives both propeller shafts and propellers under an forward drive condition and drives only one of the propeller shafts and the respective propeller under a reverse drive condition, and at least the one propeller, which is not driven under the reverse drive condition, includes the inner sleeve with the annular flanges.

18. A propulsion system as in claim 15, wherein the propeller hub includes at least one radially extending member that extends about an inner periphery of the propeller hub, and the space is defined between the annular flange of the inner member and the radially extending member of the propeller hub.

19. A propeller as in claim 18, wherein the inner sleeve and the annular flange are integrally formed.

20. A propeller as in claim 18, wherein the inner sleeve includes a relief which receives the radial extending member of the propeller hub in a manner inhibiting axial movement of the propeller hub relative to the inner member in at least one direction.

21. A propeller as in claim 18, wherein the inner sleeve includes a bearing surface and a stop arranged at one end of the bearing surface, and the radial extending member of the propeller hub contacts the bearing surface in a manner permitting a degree of axial movement of the propeller hub relative to the inner member.

22. A propulsion system as in claim 18 additionally comprising a transmission which drives both propeller shafts and propellers under an forward drive condition and drives only one of the propeller shafts and the respective propeller under a reverse drive condition, and at least the one propeller, which is not driven under the reverse drive condition, includes the inner sleeve with the annular flanges and the propeller hub with the annular flanges.

23. A propulsion system as in claim 22, wherein the transmission drives the front and rear propellers in opposite rotational directions under the forward drive condition.

24. A propulsion system as in claim 14, wherein the propeller hub includes at least one radial extending member that projects inward towards the inner member and is arranged so as to bear on the propeller shaft in at least one axial direction.

25. A propeller adapted to be coupled in driving relation with a propeller shaft of a marine drive, the propeller comprising a propeller hub supporting at least one propeller blade, an inner member adapted to be affixed against rotation relative to the propeller shaft, the propeller hub and the inner member having means for defining a space between opposing portions of the inner member and the propeller hub, a resilient coupler cooperating with the inner member portion and with the opposing hub portion to resiliently couple together the propeller hub and the inner member, the coupler being disposed within the defined space between the inner member and the propeller hub, the propeller hub having means for bearing on the propeller shaft in at least one axial direction independent of the coupling.

26. A propulsion system for a marine drive comprising a front propeller and a rear propeller arranged in series to rotate about a common axis, a pair of concentric propeller shafts, the front propeller being attached to a first propeller shaft of the pair to drive the front propeller, the rear propeller being attached to a second propeller shaft of the pair to drive the rear propeller, at least one of the front and rear propellers comprising a propeller hub supporting at least one propeller blade, the propeller hub and the inner member having means for defining a space of generally constant size between opposing portions of the inner member and the propeller hub, a resilient coupler cooperating with the inner member portion and with the opposing propeller hub portion to resiliently couple together the propeller hub and the inner member, the coupler being disposed within the defined space between the inner member and the propeller hub the propeller hub having means for bearing on the propeller shaft in at least one axial direction independent of the coupling.

* * * * *